US009784448B2

(12) United States Patent
Bertelli

(10) Patent No.: US 9,784,448 B2
(45) Date of Patent: Oct. 10, 2017

(54) METHOD FOR ELECTRONICALLY REGULATING A COMBUSTIBLE MIXTURE, FOR EXAMPLE GAS FED TO A BURNER

(71) Applicant: BERTELLI & PARTNERS S.R.L., Angiari (IT)

(72) Inventor: Pierluigi Bertelli, Legnago (IT)

(73) Assignee: BERTELLI & PARTNERS S.R.L., Angiari (IT)

( * ) Notice: Subject to any disclaimer, the term of this patent is extended or adjusted under 35 U.S.C. 154(b) by 170 days.

(21) Appl. No.: 14/385,815

(22) PCT Filed: Mar. 12, 2013

(86) PCT No.: PCT/IB2013/000375
§ 371 (c)(1),
(2) Date: Sep. 17, 2014

(87) PCT Pub. No.: WO2013/140219
PCT Pub. Date: Sep. 26, 2013

(65) Prior Publication Data

US 2015/0050606 A1 Feb. 19, 2015

(30) Foreign Application Priority Data

Mar. 19, 2012 (IT) ..... MI2012A0427

(51) Int. Cl.
*F23N 1/02* (2006.01)
*F23N 1/00* (2006.01)
(Continued)

(52) U.S. Cl.
CPC ..... *F23N 1/022* (2013.01); *F23N 1/002* (2013.01); *F23N 3/002* (2013.01); *F23N 5/123* (2013.01);
(Continued)

(58) Field of Classification Search
CPC ..... F23N 5/12; F23N 1/022
(Continued)

(56) References Cited

U.S. PATENT DOCUMENTS

RE34,298 E * 6/1993 Gitman ..... F23G 5/008 110/188
5,924,859 A 7/1999 Nolte et al.

FOREIGN PATENT DOCUMENTS

DE 19539568 C1 6/1997
DE 19618573 C1 6/1997
(Continued)

OTHER PUBLICATIONS

International Search Report and Written Opinion dated Jul. 17, 2013 for PCT/IB2013/000375 to Bertelli & Partners S.R.L. filed Mar. 12, 2013.

*Primary Examiner* — Avinash Savani
*Assistant Examiner* — Aaron Heyamoto
(74) *Attorney, Agent, or Firm* — Vorys, Sater, Seymour and Pease LLP

(57) ABSTRACT

A method for regulating the combustible mixture such as air/gas, air/methane gas or the like fed to a burner, the method including measuring a flame signal correlated with the composition of the mixture fed by feed members controlled by a combustion controller arranged to regulate the combustion on the basis of the flame signal. During burner operation the mixture feed conditions are modified within a narrow time interval to obtain a flame signal variation; a ratio between values of this the flame signal at the end and at the beginning of the interval is compared with a predetermined reference value; and, on the basis of the deviation of this ratio from the reference value, the flame set point is regulated, as consequently is the air or gas of the mixture if this is rendered necessary.

13 Claims, 2 Drawing Sheets

Figure 1:
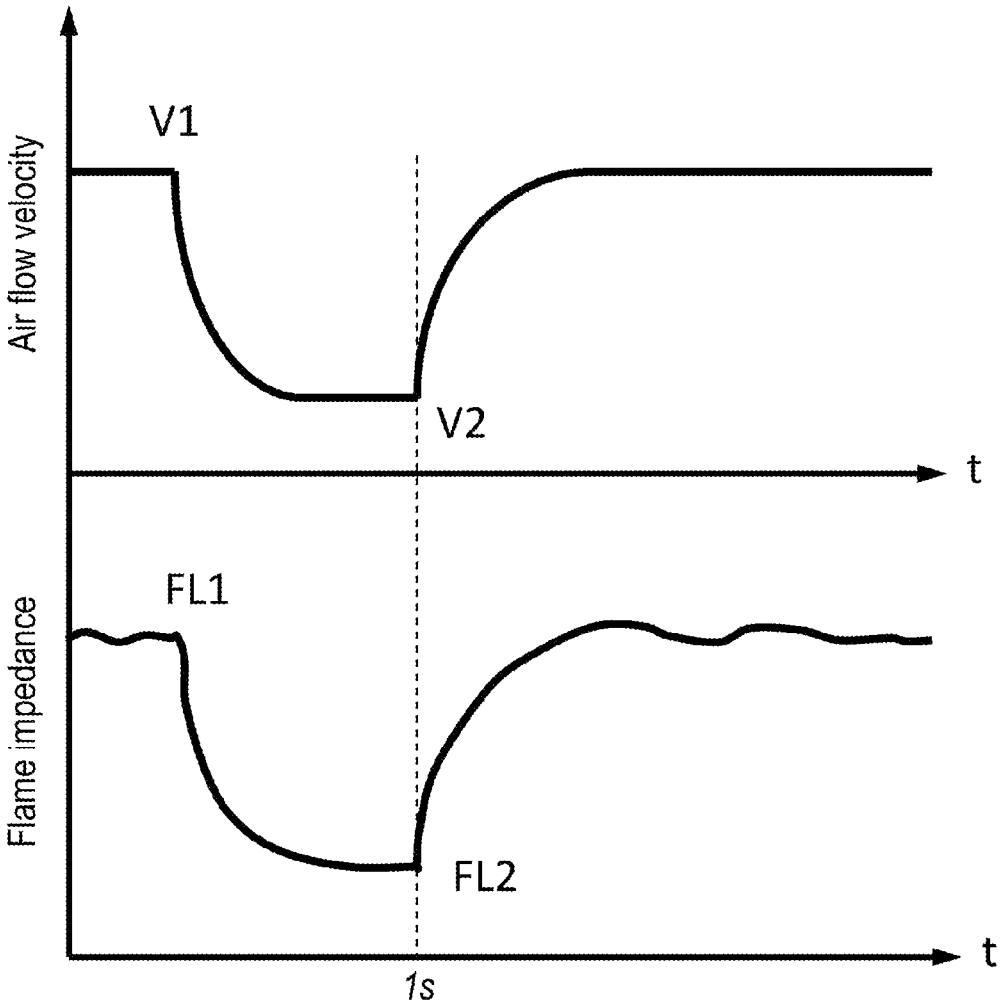

(51) Int. Cl.
*F23N 3/00* (2006.01)
*F23N 5/12* (2006.01)

(52) U.S. Cl.
CPC *F23N 1/00* (2013.01); *F23N 3/00* (2013.01); *F23N 5/12* (2013.01); *F23N 2027/20* (2013.01); *F23N 2033/08* (2013.01)

(58) Field of Classification Search
USPC ..... 431/12, 2
See application file for complete search history.

(56) References Cited

FOREIGN PATENT DOCUMENTS

| | | | |
|---|---|---|---|
| DE | 10220773 | A1 | 11/2003 |
| WO | 2011/117896 | A1 | 9/2011 |

* cited by examiner

METHOD FOR ELECTRONICALLY REGULATING A COMBUSTIBLE MIXTURE, FOR EXAMPLE GAS FED TO A BURNER

CROSS-REFERENCE TO RELATED APPLICATIONS

This is a §371 National Stage Application of International Application No. PCT/IB2013/000375 filed on 12 Mar. 2013, claiming the priority of Italian Patent Application No. MI2012A000427 filed on 19 Mar. 2012.

The present invention relates to an improved method for regulating a combustible mixture fed to a burner, in accordance with the introduction to the main claim.

A generic burning device for an air/gas mixture is known to consist usually of a fan velocity-controllable (or controllable by another equivalent system for adjusting the combustion air flow rate) for providing the necessary combustion air, a gas operator or regulator able to control the exiting gas flow rate; this device comprises a burner to which the resultant air/gas mixture is conveyed, and a mixture ignition device. A usual electrode enables the burning device to be controlled by an electric signal deriving from the flame formation as sensed by said electrode and sent to a control unit for the burning device.

Said electric signal is a flame signal, which defines any electrical quantity measurable by a powered electrode immersed into the flame generated by igniting a combustible mixture. This signal can be either a current signal (I) or an impedance (R) the values of which are inversely related. For example, conventionally a measurable current increase corresponds to a decrease in the flame impedance. The opposite reasoning applies when speaking of a signal decrease.

In a system such as the aforedescribed, the electric signal deriving from the flame has a relationship with the mixture and in particular with its air excess (lambda). Various devices are known which, by operating on this relationship, electronically regulate the combustible mixture in order to achieve correct functioning of the burner (and hence of the device of which it forms part), which is reliable and operates in such a manner as to be non-pollutant in accordance with precise regulations.

The flame signal is generally provided with its own set point value in order to achieve said correct burner operation, the continuously measured flame signal being regulated by a regulating system if different from the set point value, by acting on the air quantity or on the gas quantity fed to the burner (for a given working power, the air quantity remains fixed and the gas quantity is varied). However, the flame signal suffers variations due to various problems linked for example to oxidation, to mechanical creep, to the degree of pollution of the environment in which the electrode operates, to irregular installation or tightening conditions, etc. The aforesaid mixture regulating devices must therefore be able to sense when the read flame signal no longer corresponds to that predetermined for a given lambda value (coefficient which defines the ratio of air/gas fed to the burner). This is to prevent a mixture regulation being obtained such as to cause the burner to operate outside allowable limits which would be potentially dangerous for the environment and for man.

Regulating devices are known, for example from U.S. Pat. No. 5,924,859 or DE 195 39 568 or DE 196 18 573, which provide for periodically carrying out a sort of self-test or automatic calibration which consists, when at a certain previously defined power and when the burner is under stable operating conditions, of progressively enriching the mixture (by reducing the air excess) until the stoichiometric working point is exceeded then measuring the maximum point of the signal, considered to correspond precisely to the stoichiometric combustion point. Having measured this, the set point signal is defined as a fraction of said measured maximum value.

These and other similar known devices present various drawbacks.

For example, they operate on the assumption that the aforestated relationship is valid, constant and repeatable under all conditions and within the entire power range, such that calibration needs to be carried out only in one point (i.e. at a given power value) to achieve set point self-correction. In reality this is partially valid only if working within a predefined rated power range, outside of which the rule is not valid.

Temperature regulation must also be deactivated for a time which depends:

a) on the starting power (the system requires a certain time to reach the designated power for the calibration);
b) on a minimum of time required for thermal stabilization of the measurement starting point;
c) on the time required for carrying out the actual calibration (mixture enrichment, exceeding the stoichiometric point, and measurement); and
d) on the time required to return to the starting power.

The duration of this time is not inconsiderable, and during that time the regulating device excludes burner temperature control (regulation), so penalizing user comfort. To this is added the impossibility (or difficulty) of carrying out the calibration if the system is requesting a lower power and is already at the allowable water temperature limits.

Another important negative aspect is that there is high CO emission during calibration (although considered negligible), generated by exceeding the stoichiometric combustion point.

Finally, it is important to note that the method is imprecise in that, as better explained later, the maximum value of the signal depends on several factors: not only on the initial lambda value, but also on the duration of the calibration procedure, on system tolerances, etc.; the result is that this maximum value can be displaced by as much as 30-35%, with consequent error in evaluating the new set point for the reference flame.

WO 2011/117896 describes a method of controlling a boiler with a sealed combustion chamber and provided with an atmospheric burner comprising a control valve for the gas fed to a burner, means for sensing the flame present in this latter, and control means for boiler functional members such as the gas valve, a fan provided with its own electric motor, a circulator or pump, and a temperature probe. These control means cooperate with a memory in which a plurality of boiler working conditions are tabulated based on characteristics related to the flame, to the thermal operating power of the boiler, and to the combustion quality index or lambda.

When under operating conditions, the boiler working point is determined on one of these curves, and the ratio of combustion air to gas is modified starting from a current working value in order to displace this working point along the curve; if this ratio variation results in a predefined value, the combustion is considered correct at said working point, and the previous air/gas ratio is restored, whereas in the opposite case the gas flow rate is modified such as to reach a working point with non-polluting combustion.

In this prior patent the object is to offer a method and device for controlling a boiler of the aforesaid type such that it operates within non-polluting combustion levels. A particular object is to eliminate the use of mechanical members for controlling the boiler draught and to ensure clean combustion even under the aforelisted irregular working conditions.

However this prior patent does not describe a method for determining a precise working set point for the flame signal, but states that the value of this latter should be modified to modify the boiler working point and to shift it along a particular curve until arriving at a predetermined value, to evaluate correct boiler combustion at the initial working point. On the basis of this evaluation, burner operation is restored at this working point, or this latter is modified to attain a non-polluting working point.

This prior patent hence does not describe, for a given application (depending for example on the type of gas used), a correct set point or value for the flame signal, used to regulate combustion at a desired value, but in contrast carries out a comparison between a flame signal value defining a particular working point at which the boiler is to operate, and a predetermined value, to verify whether the boiler operating condition is such as to have or not to have non-polluting combustion.

An object of the present invention is to provide an improved method for regulating a combustible mixture to a burner which enables correct combustion to be maintained, while at the same time overcoming the aforesaid problems of state-of-the-art solutions.

A particular object of the invention is to provide a method of the stated type which is reliable and operates on precise information regarding the mixture fed to the burner, so as to enable optimal operation of this latter within current regulations.

Another object is to provide a method of the stated type which can be implemented very frequently during the use of the burner.

A further object is to provide a method of the stated type which can be used both to supervise combustion such as to be correctly controlled in accordance with regulations without exceeding the CO emission limits (to satisfy safety regulations), and to calculate and/or dynamically correct the flame set point value, a determining factor for feedback or rather for controlling combustion, and the composition of the mixture fed to the burner, and hence maintain the oxygen regulated at the required value.

These and other objects which will be apparent to the expert of the art are attained by a method in accordance with the accompanying claims.

Figure 2:
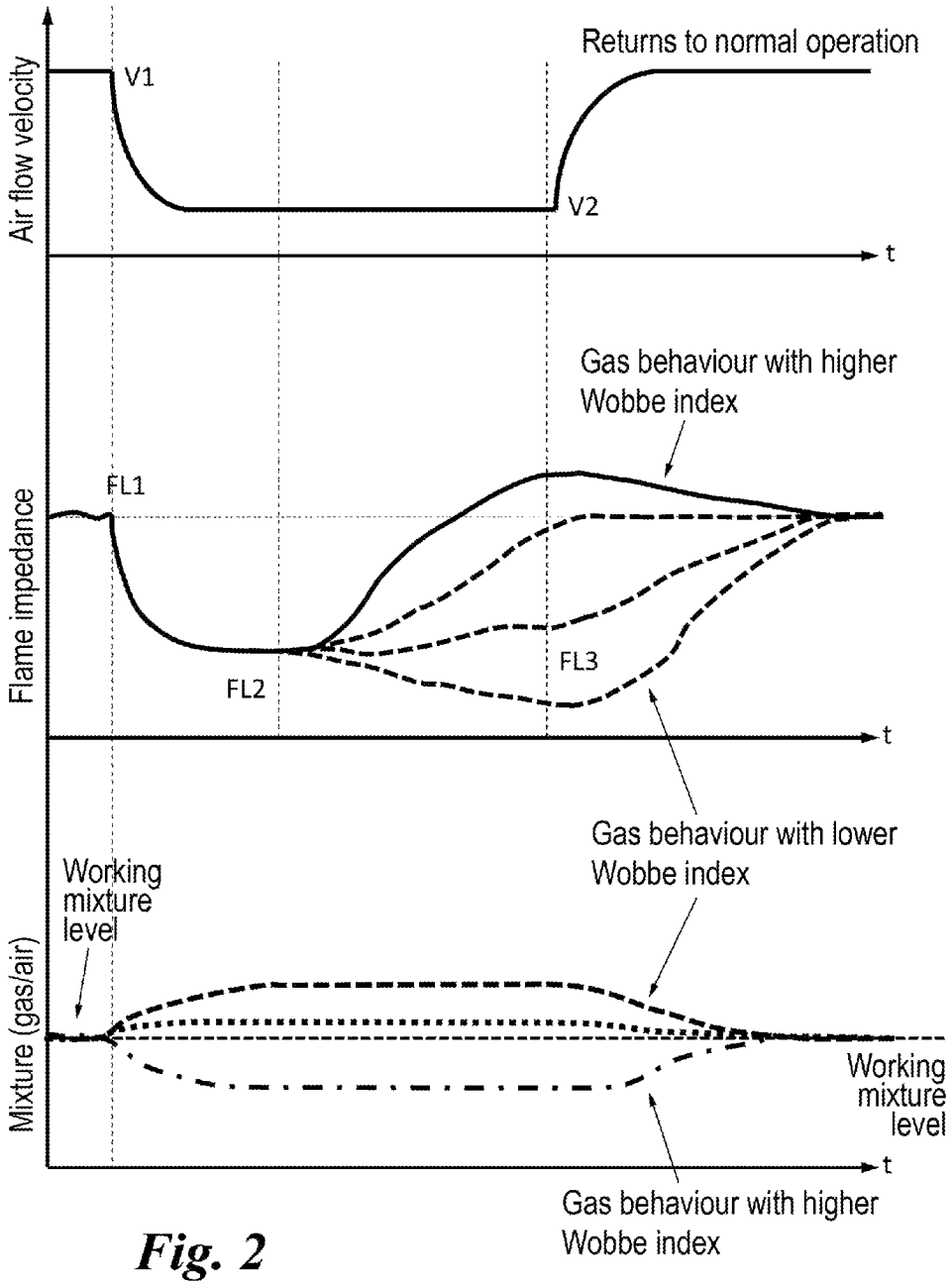

The present invention will be more apparent from the accompanying drawings, which are provided by way of non-limiting example and in which:

FIG. 1 shows a graph relative to a first mode of implementing the invention; and FIG. 2 shows a graph relative to a second mode of implementing the invention.

With reference to FIG. 1, this shows a graph showing two curves relative to the variation of combustion air flow velocity (upper part of the graph) against time and the variation of impedance corresponding to a flame signal FL against time. This signal and air flow are measured and generated by respective means which are known and do not form part of the present document.

The invention is based on various theoretical assumptions for its implementation.

A first assumption regards the fact that the flame signal depends on the distance of the flame front from the burner where this is generated, this distance being the attained equilibrium point, for a given power regime, between the combustion velocity and the mixture exit velocity.

A second point on which the invention is based (first characteristic which differentiates it from the aforestated prior patents) is that the maximum signal value does not correspond to the stoichiometric point i.e. to an air/gas ratio equal to one, but can vary for example according to the type of combustible gas.

It is further considered that the flame signal measured during the combustible mixture calibration is not the maximum flame signal attainable in that it is strictly related to the combustion velocity (as aforestated) which is itself strictly related to the mixture temperature. In this respect, this signal is more dependent on the mixture temperature than on the air excess. It is in fact known that during calibration (which takes place in the aforesaid prior solutions) the mixture temperature rises as the mixture is enriched, the combustion velocity increases and the mixture preheat temperature increases, with consequent increase in the flame signal; the system inertias (which are characteristic time constants) can hence influence, according to the manner of carrying out said calibration, the maximum flame value and therefore the accuracy and reliability of the result of the calibration, in a process which would reach equilibrium in an extremely lengthy time unacceptable for the required application. On the basis of the aforestated assumptions, the invention relates to a method for controlling the flame signal and hence the combustible mixture fed to a burner, which is independent of the mixture temperature and of the preheat of the mixture at the start of the procedure.

According to the invention, during burner operation a quick-time modification is made to the combustion conditions, and a reference value (set point) is measured by a system for rapid reading of the flame signal, for use in calculating a new set point which does not necessarily correspond to the maximum value of this signal or rather to the stoichiometric value during burner operation. This new value is a precise value which is subsequently used for a further time control of the boiler operative conditions.

Hence the invention does not determine whether or not the burner operates under optimal conditions (i.e. non-polluting) by comparison with a previously fixed value of the flame signal set point, but instead dynamically determines continuously with time, during burner operation, set point values with which to compare successive corresponding flame signal values. All this is achieved independently of a predetermined stoichiometric value, but in a manner which considers the current burner operative situation on the basis of its combustion conditions which depend on the mixture fed to the burner.

The present method exploits the variation in the mixture combustion velocity, i.e. the movement of the flame front, which is mainly dependent on the flame composition and, for its rapid implementation, independent of the aforesaid negative influences linked to the mixture variation or modification during implementation of the method.

According to a preferred but non-binding embodiment of the invention shown in FIG. 1, the mixture velocity is for example reduced (by instantaneously reducing the r.p.m. of a fan feeding this mixture to the burner).

According to the invention, the fan velocity is reduced, for example by a predetermined r.p.m. or by a percentage of the r.p.m. undergone by the fan at the start of the test stage in which the method is implemented. This reduction takes place in a maximum time of 30 seconds, advantageously less than 5 seconds (and preferably within 1-2 seconds), this time being defined on the basis of the system thermal inertias. The final measurement of the flame signal is undergone within 2-5 seconds from the start of the test, when the rotational velocity of the fan (or the air flow velocity) has stabilized.

A control unit, which preferably also controls the operation of the entire device of which the burner forms part, measures the initial value and the final value of the flame signal in order to calculate a new set point which is dependent on these two values. The calculation depends in particular on the relationship which links the ratio of initial flame value to final flame value of the test (FL1 and FL2 in FIG. 1) at the composition of the combustible mixture present at the commencement of the test (working mixture), whereas it does not depend only on the measured maximum value (or on a single value) precisely because of the characteristic of dynamic measurement of the flame front movement.

The calculated new set point is hence a function of the value present at the test commencement and of a coefficient which depends on the measured percentage variation of the flame signal (FL2/FL1) relative to an expected signal percentage variation value defined at the burner design stage and specific for the mixture velocity variation (i.e. the fan velocity) applied during the test. By simplifying (conventionally considering the flame signal in terms of impedance and not of current), then typically:

- in the case of a correct mixture the percentage signal variation will be virtually identical to the reference percentage variation, hence the calculation confirms the initial set point, which will be maintained.
- in the case of a starting mixture with high air excess, the flame signal will have a percentage variation greater than expected and hence the new calculated set point will be lower than the preceding (leading to an increase in the air quantity to the burner).
- in the case of a starting mixture with low air excess, the flame signal will have a percentage variation lower than expected and hence the new calculated set point will be higher than the preceding (consequently reducing the gas quantity).

The ratio of initial flame signal to final flame signal is hence a function of the ratio of the initial mixture velocity (i.e. of the fan) to the final mixture velocity, which can be chosen for technical convenience to achieve greater measurement precision.

By acting in this manner, the following advantages are obtained:

I. in regulating the mixture, the influence of final flame temperature or of the mixture itself is eliminated. This is because the quickness of implementation (mixture velocity/feed variation), which must be considerably less than the time constant of the electrode-flame-burner-mixture system, does not lead to a variation, other than negligible, of the system temperature (measured experimentally within 5% against the 20-30% of traditional calibration). At the same time any possible inaccuracy due to the high temperature at the end of calibration is eliminated;

II. the signal variation is more dependent on or rather correlated with the mixture and hence better represents this latter;

III. during the procedure the variation of the mixture velocity (movement of the flame front) is utilized to a greater extent than the mixture composition variation (principle on which previously stated patents are instead based), so much so that the present method can be effectively implemented even (by way of non-binding example) without changing or only limitedly changing the air/gas ratio, in contrast to traditional systems. This, together with the high implementation rate, considerably reduces the CO quantity emitted (indicatively up to 1/10 of the total quantity emitted during this state in traditional systems) hence, under normal operation starting conditions, being below the values allowable by law (whereas the calibration carried out in the state of the art generates a considerable CO quantity by definition: it in fact has necessarily to pass beyond the stoichiometric point).

This gives the considerable advantage of being able to implement the regulation method very frequently during burner operation (not periodically, typically once a day, as in traditional systems), with a greater guarantee of combustion stability and greater user safety.

Moreover the lack of need, or reduced need, to vary the mixture (there is in fact no need to increase the gas flow rate beyond the rated value) enables the method to be implemented even at high powers as there are no limits on mains gas feed or on delivery by the gas actuator.

Another advantage of the invention is that the method can be implemented at the required power with only negligible influence on the regulation under way. This results not only in greater comfort but also in the ability to also apply the system where calibration is not applicable (for example at very low powers) where the simple relationship with the maximum value at one point is not applicable, as happens in known solutions, it being implementable at different working powers, then interpolating the result. This situation is typical of those applications in which a wide working range is requested, for example a modulation ratio (i.e. a ratio of minimum power to maximum power) of 1:7 . . . 1:15 or greater.

The method can be applied either in reducing or increasing the fan velocity, in both cases exploiting the mixture velocity variation or its influence on the combustion velocity.

The same method can be used not only for precise combustion regulation (regulation of the prechosen O2 value for a given working power value) but also for just verifying the combustion hygienicity (known simply as a combustion test), i.e. verification that the combustion is within the CO emission levels fixed by the product regulations. In this case, the percentage flame signal variation is compared with at least one predetermined value. If this variation reaches a minimum equal to the predetermined value or a value within a certain window about the predetermined value, the test stage is terminated (with consequent reduction of the implementation time). In this embodiment, the method is used only for confirming that the mixture is burning without passing beyond the regulation limits relating to CO emission. If the ratio of the flame signal value to the predetermined value do not match, the set point is corrected for mixture regulation as in the previously described method.

The method of the invention allows a further operative opportunity known as Wobbe Index Compensation (hereinafter WIC).

In gas adaptive applications (which operate independently of the mains gas quality) or in multi-gas applications in which a single mechanical part (nozzle, mixer, etc.) is defined for operation with different gas families, as the pneumatic action of the gas actuator is different according to the type of gas being burned for equal working regimes (in that the pressure drop, or delta P, determined by the gas flow and hence the working pressure are different), it behaves differently on the basis of a given upward/downward pressure variation determined by a fan velocity variation. With reference to FIG. 2, starting from a pressure variation as in FIG. 1 (or by implementing exclusively a WIC procedure)

the fan velocity is reduced (by way of non-binding example) and the flame signal decreases instantaneously by the effect of the mixture velocity variation (similar to that which takes place in FIG. 1). Then, instead of returning the fan to the initial velocity value, the velocity is maintained at the value attained. The system is allowed to stabilize with a new obtained mixture, which will be richer in gas for gases at low Wobbe index and poorer in gas for gases at high Wobbe index.

The flame signal then follows at the same rate the pattern of the mixture by the effect of waiting, and determines with good reliability the gas type (family), on the basis of the pattern, and of the ratio or difference between the starting flame signal and the flame signal at the procedure end.

This method variation enables the system to understand the working gas type/family and to consequently act on the basis of that sensed (automatic gas type/family sensing, automatic adaptation of working algorithms where necessary, etc.).

The implementation time is longer although shorter overall than calibration (previous patents).

The method according to the present variation can be implemented periodically with very low frequency if sufficient to understand to which family the working gas pertains or, more frequently, precisely to compensate the Wobbe index where necessary because of the variability of the mains gas.

The invention claimed is:

1. A method for regulating the combustible air/gas mixture fed to a burner, said method comprising:

dynamically determining continuously with time, during burner operation, set point values with which to compare successive corresponding flame signal values, comprising measuring a series of sequential flame signals correlated with composition of said mixture and based on successive pairs of said flame signals sequentially calculating said set point values;

feeding air and gas to the mixture by corresponding feed members, which are controlled by a combustion control means arranged to control and regulate combustion on the basis of a working said set point value of the flame signal;

during operation of the burner, wherein combustion is regulated on the basis of the working set point value, modifying mixture feed conditions within a narrow time interval to obtain a flame signal variation, wherein the narrow time interval is less than a time constant of an electrode-flame-burner-mixture system;

measuring an initial said flame signal at a beginning of the narrow time interval;

measuring a final said flame signal at an end of the narrow time interval;

comparing a ratio between values of the final flame signal at the end of said interval and the initial flame signal at the beginning of said interval with a predetermined reference value;

on the basis of deviation of the ratio from the reference value, recalculating a new working set point value of the flame signal, and consequent to this recalculation, possibly regulating the mixture air or gas; and with the new working set point value, comparing a subsequent ratio between initial and final flame signal values obtained during a subsequent narrow time interval in which the mixture feed conditions are again modified to control the combustion.

2. The method as claimed in claim 1, wherein the corresponding feed members for feeding said air and said gas comprise a fan for the air and a valve for the gas, wherein the mixture feed conditions are modified by modifying the velocity of the air fan to modify the air/gas mixture fed to the burner.

3. The method as claimed in claim 1, wherein the mixture feed conditions are modified by modifying the gas quantity fed to the burner.

4. The method as claimed in claim 1, comprising evaluating the deviation of the flame signal values measured at the end and at the beginning of said interval from the predetermined reference value;

wherein the calculated new set point is a function of the set point value present at the beginning of the respective time interval and of a coefficient which depends on the measured percentage variation of the flame signal calculated as a ratio of the final flame signal / the initial flame signal (FL2/FL1) relative to an expected reference signal percentage variation value defined at the burner design stage and specific for the mixture velocity variation;

wherein in the case of a correct mixture the measured percentage signal variation will be virtually identical to the expected reference signal percentage variation, hence the calculation confirms the initial set point, which will be maintained as the new set point;

wherein in the case of a starting mixture with high air excess, the flame signal will have a percentage variation greater than the expected reference signal percentage variation and hence the new calculated set point will be lower than the preceding set point leading to an increase in the air quantity to the burner; and wherein in the case of a starting mixture with low air excess, the flame signal will have a percentage variation lower than the expected reference signal percentage variation and hence the new calculated set point will be higher than the preceding set point consequently reducing the gas quantity.

5. The method as claimed in claim 1, wherein said reference value is an expected value of the variation of said flame signal ratio defined at the design stage and specific for the variation in the feed conditions of the prechosen combustible mixture.

6. The method as claimed in claim 1, wherein, subsequent to the modification of the mixture feed conditions, the method comprises a step selected from the group consisting of:

a) to control the flame signal via an impedance value;

b) to maintain the current combustible mixture if the ratio of the flame signal values does not substantially deviate from the predetermined reference value;

c) to increase the gas quantity if the ratio of the flame signal values increases beyond the reference value;

d) to reduce the gas quantity if the ratio of the flame signal values decreases relative to the reference value.

7. The method as claimed in claim 1, wherein the time interval within which the feed conditions are modified is a function of the system thermal inertia and is less than or equal to 30 seconds, subsequent to which interval the new flame signal is measured within a time less than or equal to 30 seconds, said new flame signal value also being a function of the system thermal inertia, the flame signal value being used to calculate the flame signal value ratio and to compare the flame signal value ratio with the reference value.

8. The method as claimed in claim 1, comprising comparing the flame signal value ratio with at least one reference value to verify whether the combustible mixture is burning without passing beyond the limiting values for CO emission.

9. The method as claimed in claim 1, wherein the method is implemented at any power at which the burner is operating, to define different velocity/feed variation conditions for the combustible mixture and different calculation coefficients as a function of the working power.

10. The method as claimed in claim 1, wherein after varying the mixture feed conditions, this condition is maintained for a predetermined time, the pattern of the flame signal within this time is evaluated and on the basis thereof the type and family of the gas fed to the burner is defined, and then adapting the burner operation in response to this definition.

11. The method as claimed in claim 1, wherein the corresponding feed members for feeding said air and said gas comprise a fan for the air and a valve for the gas.

12. The method as claimed in claim 1, wherein the time interval within which the feed conditions are modified is a function of the system thermal inertia and is less than or equal to 5 seconds, subsequent to which interval the new flame signal is measured within a time less than or equal to 5 seconds, said new flame signal value also being a function of the system thermal inertia, the flame signal value being used to calculate the flame signal value ratio and to compare it with the reference value.

13. The method as claimed in claim 1, wherein the time interval within which the feed conditions are modified is a function of the system thermal inertia and is less than or equal to 30 seconds, advantageously less than 2 seconds, subsequent to which interval the new flame signal is measured within a time less than or equal to 3 seconds, said new flame signal value also being a function of the system thermal inertia, the flame signal value being used to calculate the flame signal value ratio and to compare it with the reference value.

* * * * *